US005367219A

United States Patent [19]

Friederichs

[11] Patent Number: 5,367,219

[45] Date of Patent: Nov. 22, 1994

[54] IMPROVED ELECTRIC REFLECTOR LAMP FOR USER WITH IEC STANDARD

[75] Inventor: Winand H. A. M. Friederichs, Eindhoven, Netherlands

[73] Assignee: U.S. Philips Corporation, New York, N.Y.

[21] Appl. No.: 961,556

[22] Filed: Oct. 15, 1992

[30] Foreign Application Priority Data

Nov. 18, 1991 [EP] European Pat. Off. ..... 91202979

[51] Int. Cl.[5] ..... H01K 1/46

[52] U.S. Cl. ..... 313/113; 313/318; 362/377; 439/612; 439/615

[58] Field of Search ..... 313/113, 318; 439/611, 439/612, 613, 615; 362/376, 377, 344, 457

[56] References Cited

U.S. PATENT DOCUMENTS

| | | | |
|---|---|---|---|
| 4,166,232 | 8/1979 | Kimball, III et al. | 313/318 |
| 4,264,840 | 4/1981 | Kuhnert et al. | 313/318 |
| 4,658,178 | 4/1987 | Bradley et al. | 313/113 |
| 4,779,021 | 10/1988 | Haraden | 313/318 |
| 4,959,583 | 9/1990 | Arsena et al. | 313/318 |
| 4,982,132 | 1/1991 | Meyer et al. | 313/113 |
| 4,988,912 | 1/1991 | Borgis | 313/318 |
| 5,057,735 | 10/1991 | Zalar et al. | 313/318 |

FOREIGN PATENT DOCUMENTS 042293 4/1991 European Pat. Off. .

*Primary Examiner*—Donald J. Yusko
*Assistant Examiner*—Vip Patel
*Attorney, Agent, or Firm*—Paul R. Miller

[57] ABSTRACT

The electric lamp includes a moulded reflector body (1) having a neck-shaped portion (12) which has an end portion (13). A lamp cap (2) is connected to the neck-shaped portion (12). An insulator body (5) surrounds the end portion (13). The insulator body is a ring which is wider than the lamp cap (2), and extends completely about the neck-shaped portion (12). The lamp cap (2) surrounds the end portion (13) and is directly attached thereto. The electric lamp is able to comply with an IEC requirement, while components of the lamp can be used to assemble a lamp complying with an ANSI requirement, without employing additional or different components.

6 Claims, 2 Drawing Sheets

IMPROVED ELECTRIC REFLECTOR LAMP FOR USER WITH IEC STANDARD

The invention relates to an electric reflector lamp comprising:

- a hollow moulded reflector body having an optical axis and having a neck-shaped portion which has a free-end portion;
- a lamp cap provided with contacts and connected to the neck-shaped portion;
- a light source arranged in the reflector body and electrically connected to the contacts of the lamp cap by means of current conductors;
- an insulator body around the free-end portion of the neck-shaped portion,
- a stop being present for limiting the depth to which the neck-shaped portion enters the insulator body.

BACKGROUND OF THE INVENTION

Such a reflector lamp is known from European Patent No. EP-0 422 936 A2.

The known lamp has a neck-shaped insulator body with a wide portion which surrounds the neck-shaped portion over the major part of the latter's length, and a narrow portion which is accommodated in the lamp cap.

In the known lamp, the insulator body has the object of preventing light from radiating from the neck-shaped portion to the exterior as a result of an imperfect coating of that portion with a mirroring layer.

A disadvantage of the known lamp is that the insulator body must be fastened to the reflector body with a first adhesive compound. It is apparently necessary for this to provide the insulator body with a projection and the reflector body with a groove cooperating therewith in order to give the fastening the required torsional strength. A second adhesive compound is necessary for fastening the lamp cap to the insulator body.

The projection and groove may at the same time form the stop for limiting the depth to which the neck-shaped portion enters the insulator body. The reflector body, which is externally conical, and the insulator body, which is internally conical, however, by their very shape and dimensions already constitute a depth stop, i.e. a stop in the direction of the optical axis.

The known reflector lamp complies with the ANSI standard for the dimensions of the lamp contours. This standard envisages inter alia to prevent that a lamp can be screwed tightly into a lampholder without the lamp cap thereby making electrical contact with the bottom of the lampholder. The known lamp for this purpose has a width in the immediate vicinity of the lamp cap which corresponds to the greatest width of the lamp cap.

Another disadvantage of the known lamp is that the lamp does not comply with the IEC standard as regards its contours. This standard is in contradiction to the ANSI standard and indeed requires the width of the lamp in the immediate vicinity of the lamp cap to be greater than the width of the lamp cap. The object of this standard is to avoid that the lamp cap can be touched when the lamp is inserted into a lampholder.

SUMMARY OF THE INVENTION

It is an object of the invention to provide an electric reflector lamp of the kind described in the opening paragraph which is of a simple construction that can be readily manufactured. In particular, it is an object to provide a lamp which can comply with the IEC standard and which is capable of complying with the ANSI standard without different or additional components.

According to the invention, this object is achieved in that the insulator body is a ring which is wider than the lamp cap and which in its entirety surrounds the neck-shaped portion, while the lamp cap surrounds the free-end portion and is directly fastened thereto.

The ring in the lamp according to the invention essentially has no constructional function, in contrast to the insulator body of the known lamp. The ring accordingly need not be fastened, for example, with an adhesive. It is sufficient for the ring to be present. The ring is then capable of complying with the IEC standard. Without the use of different or additional components, a lamp which can comply with the ANSI standard is obtained from the same components in that the ring is left out during lamp assembly.

It is noted that one reflector body may be used for two types of lamps. The reflector body is an expensive lamp component because of the cost of the mould in which the body is formed, for example by pressing, for example, from glass.

It is further noted that the measure in the lamp according to the invention yields a lamp of high quality and at the same time of a low cost price. If a reflector body itself were to have a great width at its free-end portion, this body would have to have a greater wall thickness in the neck-shaped portion. The lamp would then be comparatively heavy, but also sensitive to heat shocks. Alternatively, the reflector body could have a neck-shaped portion which is comparatively wide not only externally, but also internally, so that the wall thickness is comparatively small. Lamp quality would be less good also in such a case because an internally wide neck-shaped portion causes a greater hole in the reflector surface area in the location where the neck-shaped portion merges into it, so that the reflector body collects less light into a beam. Alternatively, a projecting collar could be formed at the neck-shaped portion, integral therewith. This, however, would increase the cost price of the lamp because a multiple, and thus much more expensive, mould would then be necessary for forming the reflector body.

The reflector body may be moulded from glass or formed from a synthetic resin by, for example, pressing, casting, or injection-moulding. The reflector body may be closed off in the finished lamp with a lid which is fastened, for example, with cement. Pollution of the reflector can be counteracted by this. The lid, however, may in addition have an optica/function, for example, for forming a beam or smoothing the light.

The lamp cap may be fastened to the reflector body in a conventional manner with, for example, glue or cement. In an attractive embodiment, however, the free-end portion has one or several pits into which the lamp cap is dimpled. Such pits may be readily obtained without provisions in the mould in that the reflector body is dented while still hot upon leaving the mould.

The insulator body may be made of, for example, ceramic material. Favorable, however, is a body of synthetic resin, for example, of thermoplastic resin such as, for example, polyphenylene sulphide.

In a favorable embodiment, the insulator body is U-shaped in axial section. The bottom of the U may have a small thickness, for example, of the order of 1 mm, while the legs of the U have a greater length chosen so as to be convenient.

In an embodiment, the bottom of the U abuts against a stop at the free-end portion, while the lamp cap abuts against the ring. The lamp cap is then remote by no more than the small distance equaling the thickness of the bottom of the U from the position in which the lamp cap would be if it should abut against the stop at the free-end portion if the ring were absent. The presence of the ring then has a negligible influence on the total axial dimension of the lamp.

In a modification, the ring has a radial recess in its bottom. Alternatively, the ring may have several or a plurality of such recesses. Such recesses may render it possible for pits in the flee-end portion to be freely accessible to tools in order to dimple the lamp cap into them. In the case in which the ring may have one out of a number of rotational positions about the neck-shaped portion, it is favorable for the ring to have the same number of recesses, so that the ring can be provided without being aligned.

The light source may be, for example, an incandescent body or a pair of electrodes in an ionizable gas. A light source in an inner envelope which is sealed in a gas-tight manner is favorable.

The lamp is of an easy-to-assemble construction when the inner envelope of the light source has a seal which is accommodated in an opening, for example, in metal plate which rests against a narrowed portion in the neck-shaped portion. The inner envelope may be fixed, for example, with cement.

The reflector body may have a bottom in the neck-shaped portion with openings therein through which respective current conductors extend.

In a favorable embodiment, the light source is mounted in the insulator body so that the current conductors are fixed tautly tensioned to the bottom. This may be very readily realized in an embodiment in which respective tubes are provided around the current conductors, resting against the bottom at the side thereof facing the lamp cap and fastened to the current conductors, for example, by flattening and/or welding. It is favorable when the tube becomes wider towards the bottom, for example, conically.

BRIEF DESCRIPTION OF THE DRAWINGS

An embodiment of the electric reflector lamp is shown in the drawing, in which.

DESCRIPTION OF THE INVENTION

Figure 1:
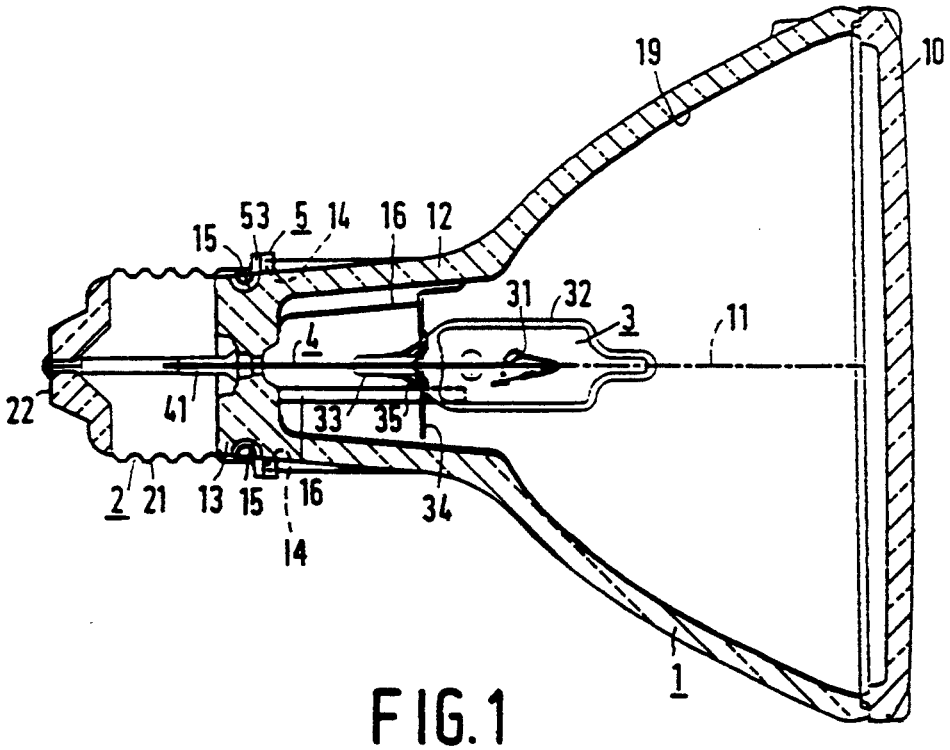
FIG. 1 is an axial section of a lamp.
Figure 2:
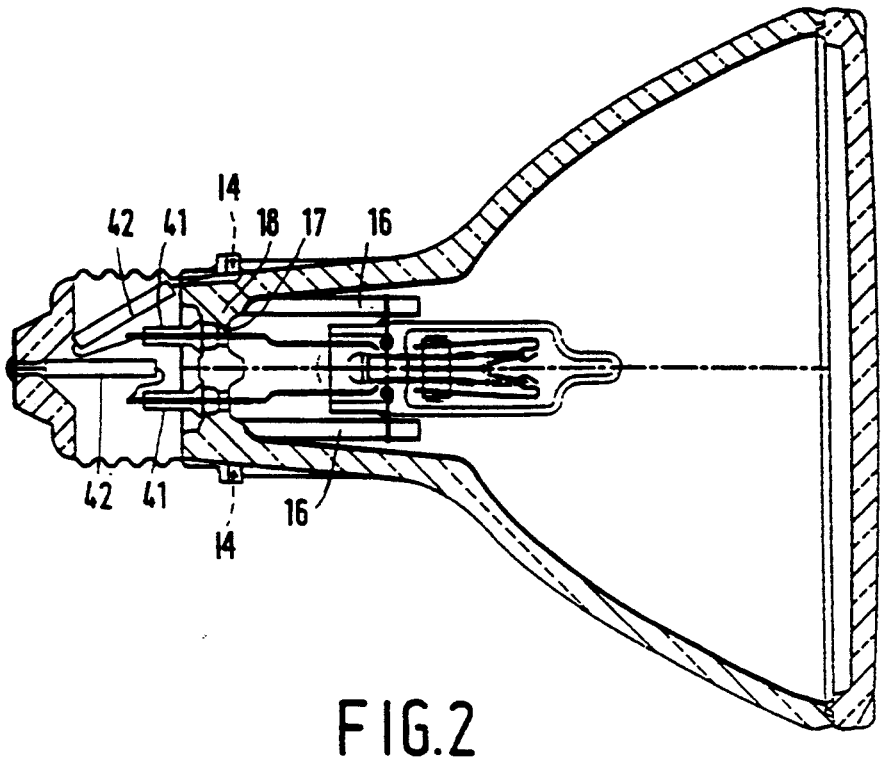
FIG. 2 shows the lamp of FIG. 1 rotated through 90°.

In FIGS. 1 and 2, the electric reflector lamp has a hollow moulded reflector body 1, for example, moulded from glass, with an optical axis 11 and a neck-shaped portion 12 having a free-end portion 13. The reflector body has a mirror coating, for example internally, such as a vapor-deposited aluminum layer 19. The reflecting surface is smoothly curved. Alternatively, it may be faceted or, for example, subdivided into axial lanes. The reflector body 1 shown is closed off by a lid 10, for example made of moulded glass, which is fixed, for example, with cement. A lamp cap 2 which is provided with contacts 21, 22 is connected to the neck-shaped portion. A light source 3 is arranged in the reflector body and electrically connected to the contacts of the lamp cap 2 by current conductors 4. The light source in the figures is an incandescent body 31 in an inner envelope 32. An insulator body 5 is arranged around the free-end portion 13 of the neck-shaped portion 12. A stop 14 is present, formed in the figures by axially extending ridges, for limiting the depth to which the neck-shaped portion 12 enters the insulator body 5.

The insulator body 5 is a ring, for example, made of polyphenylene sulphide, which is wider than the lamp cap 2 and in its entirety surrounds the neck-shaped portion 12. The lamp cap 2 surrounds the free-end portion 13 and is directly fastened thereto.

The insulator body 5 (FIG. 3b) is U-shaped in axial section, with a bottom 51 and legs 52. This may be further seen by way of FIG. 3*d* in which the recesses 54 extend into the insulator body from the side opposite the bottom 51.

The free-end portion 13 has a pit 15 into which the lamp cap 2 is dimpled so as to fix it directly to the free-end portion 13.

Figure 3A:
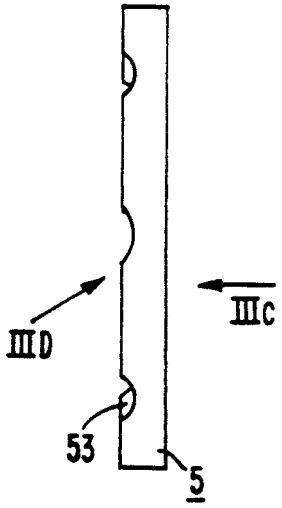
FIGS. 3*a*, 3*b*, 3*c* show the insulator body of the preceding FIGS. in lateral elevation, axial section and in elevation seen along IIIc, respectively.
Figure 3B:
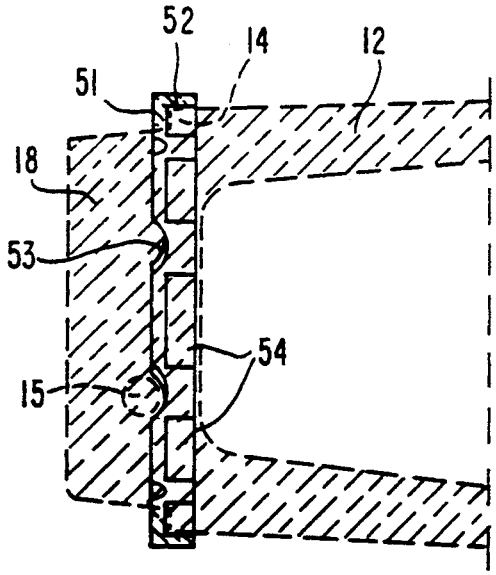
Figure 3C:
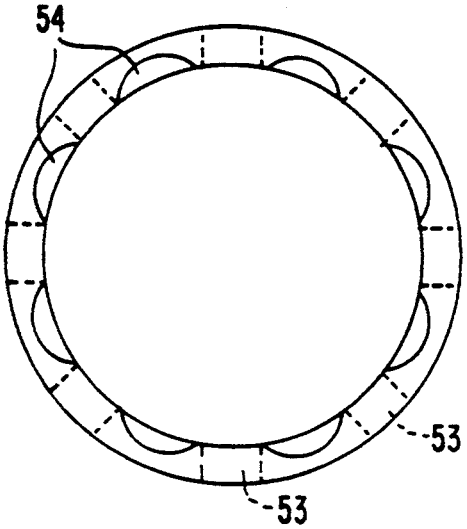
Figure 3D:
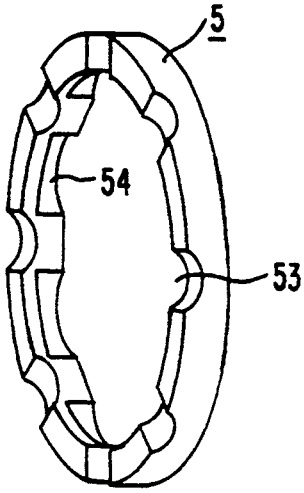

The insulator body 5, see FIGS. 3a-c, has a recess 53 in its bottom 51 near a pit 15. The insulator body also has recesses 54 for accommodating an equal number of stops 14. The axial dimension of the insulator body as a result may be chosen at will. The number of recesses 53 is equal to the number of recesses 54, so that the insulator body can be provided without being aligned.

Thanks to the presence of the insulator body 5, the lamp cap 2 of the lamp cannot be touched with a test finger after insertion into a lampholder. Owing to the small thickness of the bottom 51, the lamp cap 2 need only be farther away from the stop 14 by that thickness than in a comparable lamp not according to the invention, which does not comprise the insulator body, in order to comply with an ANSI standard.

The light source 3 (FIGS. 1, 2) has an inner envelope 32 with a seal 33 which is accommodated in a plate 34, for example, made of metal. The plate rests on a narrowed portion 16 in the neck-shaped portion 12 and has tags 35 which securely hold on to the seal 33.

The current conductors 4 run through respective openings 17 in a bottom 18 of the neck-shaped portion 12 and are fixed tautly tensioned to the bottom 18. A tube 41 is fixed around each of the current conductors 4, which tube rests against the bottom 18 at a side thereof facing the lamp cap 2. The tube 41 widens conically towards the bottom 18. Melting fuses 42 are included in the current conductors 4.

What is claimed is:

1. In an electric lamp complying with both the ANSI standard and the IEC standard, said electric lamp comprising (a) a hollow molded reflector body with an optical axis and having a neck-shaped portion, said neck-shaped portion having a free end portion, (b) a lamp cap having contacts and being connected to said neck-shaped portion, (c) a light source disposed in said reflector body and being electrically connected to said contacts of said lamp cap by current conductors, and (d) an insulator body around said free-end portion of said neck-shaped portion, wherein the improvement comprises for IEC standard only said electric lamp further comprising (e) a ring-shaped structure providing said insulator body, said ring-shaped structure entirely surrounding said neck-shaped portion at said free end portion, and said ring-shaped structure being wider than said lamp cap, and (f) at least one stop of said neck-shaped portion for limiting axial position of said ring-shaped structure on said neck-shaped portion, said lamp cap being directly fastened to and surrounding said free end portion.

2. An electric lamp according to claim 1, wherein said ring-shaped structure has an axial cross-section of a flat ring with outer extensions in the axial direction.

3. An electric lamp according to claim 2, wherein said free end portion of said neck-shaped portion has at least one pit, said lamp cap being dimpled into said at least one pit.

4. An electric lamp according to claim 3 wherein said ring-shaped structure has at least one recess in said flat ring to accommodate said at least one pit.

5. An electric lamp according to claim 1, wherein said free end portion of said neck-shaped portion has at least one pit, said lamp cap being dimpled into said at least one pit.

6. An electric lamp according to claim 5, wherein said ring-shaped structure has at least one recess to accommodate said at least one pit.

* * * * *